US008822121B2

(12) United States Patent
Pang et al.

(10) Patent No.: US 8,822,121 B2
(45) Date of Patent: Sep. 2, 2014

(54) TONER TO DEVELOP ELECTROSTATIC CHARGE IMAGE, DEVICE TO SUPPLY THE SAME, AND APPARATUS AND METHOD OF FORMING IMAGE USING THE SAME

(71) Applicant: Samsung Electronics Co., Ltd., Suwon-si (KR)

(72) Inventors: Kyeong Pang, Suwon-si (KR); Tae-hoe Koo, Suwon-si (KR); Su-bum Park, Daegu (KR); Yo-da Shin, Suwon-si (KR); Seung-jun Lee, Seoul (KR); Hae-ree Joo, Anyang-si (KR); Jun-young Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 4 days.

(21) Appl. No.: 13/778,721

(22) Filed: Feb. 27, 2013

(65) Prior Publication Data

US 2013/0224642 A1 Aug. 29, 2013

(30) Foreign Application Priority Data

Feb. 28, 2012 (KR) ..... 10-2012-0020398

(51) Int. Cl.
*G03G 9/087* (2006.01)

(52) U.S. Cl.
CPC ..... *G03G 9/08797* (2013.01)
USPC ..... 430/111.4; 430/110.2; 430/109.3; 430/108.4

(58) Field of Classification Search
CPC ..... G03G 9/08797; G03G 9/093; G03G 9/09364; G03G 9/08711
USPC ..... 430/109.3, 111.4, 110.2, 108.4
See application file for complete search history.

(56) References Cited

U.S. PATENT DOCUMENTS

| | | | | |
|---|---|---|---|---|
| 5,968,701 | A * | 10/1999 | Onuma et al. | 430/111.4 |
| 7,001,701 | B2 * | 2/2006 | Fujii et al. | 430/111.4 |
| 2009/0186290 | A1 * | 7/2009 | Yoshizaki et al. | 430/111.4 |
| 2012/0171608 | A1 * | 7/2012 | Ayaki et al. | 430/137.11 |

* cited by examiner

*Primary Examiner* — Christopher Rodee
(74) *Attorney, Agent, or Firm* — Stanzione & Kim, LLP

(57) ABSTRACT

A toner to develop an electrostatic charge image, a toner supply device employing the toner, an apparatus to form an image employing the toner, and a method of forming an image using the toner are provided. The toner includes at least a binder resin, a colorant, and a releasing agent. By using the binder resin including a combination of a reduced molar weight binder resin, an increased molar weight binder resin, and the releasing agent having an effecdtive compatibility with the binder resin together, the toner has accurately-controlled dynamic viscoelastic properties represented by a loss tangent. The toner to develop an electrostatic charge image according to an embodiment has development stability, development lifetime, fixability, charging stability, gloss, an anti-offset property, and heat storage ability at predetermined levels or higher.

6 Claims, 3 Drawing Sheets

TONER TO DEVELOP ELECTROSTATIC CHARGE IMAGE, DEVICE TO SUPPLY THE SAME, AND APPARATUS AND METHOD OF FORMING IMAGE USING THE SAME

CROSS-REFERENCE TO RELATED APPLICATIONS

This application claims priority under 35 U.S.C. §119(a) from Korean Patent Application No. 10-2012-0020398, filed on Feb. 28, 2012, in the Korean Intellectual Property Office, the disclosure of which is incorporated herein in its entirety by reference.

BACKGROUND OF THE INVENTION

1. Field

The present general inventive concept relates to a toner to develop an electrostatic charge image, a device to supply the toner, and an apparatus and method to form an image using the toner.

2. Description of the Related Art

Methods of preparing toner particles suitable to use in an electrophotographic process and an electrostatic image recording process may generally be classified into a pulverization method and a polymerization method.

Conventionally, toners used for image-forming apparatuses are mainly prepared through the pulverization method. Since the precise control of toner particle size, narrow particle size distribution, and toner shape is difficult in terms of the pulverization method, it is difficult to independently design each important property required for a toner such as charging, fixation, fluidity, or storage ability.

Thus, a polymerized toner has gained attention because controlling a particle diameter is facilitated and a complex manufacturing process such as classification is unnecessary. When a toner is prepared by using the polymerization method, a polymerized toner having a desired particle diameter and particle size distribution may be obtained without pulverizing or classification. Since a toner prepared using the polymerization method has a smaller particle diameter and a narrower particle size distribution than those of a toner prepared using the pulverization method, the polymerized toner has advantages such as improved image quality, including increased charging and transfer efficiency, broad fixing latitude, improved dot and line reproducibility, reduced toner consumption, and improved gloss properties. As an example of a method of preparing a toner by polymerization, an aggregation process has been proposed which may be performed in such a way that a binder resin, a colorant, a releasing agent, and the like are prepared in a form of particulates and an aggregation process using a metal salt is then performed thereon to control a toner particle size and shape thereof. This aggregation process allows control of a toner particle size and toner particle size distribution with reproducibility, and thus, this process has a practical use. For example, U.S. Pat. No. 6,268,102 relates to a process for the preparation of a toner which comprises mixing a colorant, a latex resin, a wax, and a polyaluminum sulfosilicate coagulant.

Even when the aggregation process is used, however, the process is still insufficient to uniformly control a toner particle size and a shape of toner particles. That is, in toner particle size distribution, when the diameters of toner particles are in a range that is greater than an average particle diameter, the shape of the toner particles can be controlled pretty well. On the other hand, when the toner particle diameters are in a range that is less than the average particle diameter, the shape of toner particles becomes approximately spherical, such that problems related to blade cleaning properties in an electrophotographic process may occur.

In particular, a toner used in a one-component contact development type image forming apparatus needs to have good blade cleaning properties.

A one-component contact development method is performed by forming a toner thin layer on a developing roller made of conductive rubber by using a blade and then contacting the developing roller with a photoreceptor to develop an electrostatic latent image formed on the photoreceptor. In this process, toner particles can be transferred to even a weak electric field region of a latent image so that minimized dot reproducibility and clear color reproducibility are facilitated. Thus, in such a one-component contact development method, a high-quality image can be obtained even with an apparatus having a simple structure. In this one-component contact development method, however, a blade is required to be firmly pressed against a surface to charge a toner on a developing roller. In addition, a photoreceptor and a developing roller contact each other, and thus, a driving torque increases as compared to a two-component development method. Moreover, toner particles may be fused on a blade so that an image defect and a charging defect are likely to occur.

As described above, in a one-component contact development method, as compared to a non-contact development method, the stress applied to the toner particles is increased due to contact between a photoreceptor and a developing roller. Thus, if the toner does not have durability with respect to such a circumstance, the toner particles are fused on the photoreceptor and the developing roller, causing contamination of an image forming apparatus and resulting in image defects.

SUMMARY

The present general inventive concept provides a toner to develop an electrostatic charge image which has a stress resistance in a developer using a one-component contact development method, improved fixing ability, and increased gloss.

The present general inventive concept also provides a device to supply the toner to develop an electrostatic charge image which has the above-stated properties.

The present general inventive concept also provides an image forming apparatus including the toner to develop an electrostatic charge image which has the above-stated properties.

The present general inventive concept also provides an image forming method using the toner to develop an electrostatic charge image which has the above-stated properties.

Additional features and utilities of the present general inventive concept will be set forth in part in the description which follows and, in part, will be obvious from the description, or may be learned by practice of the general inventive concept.

According to an exemplary embodiment of the present general inventive concept, a toner to develop an electrostatic charge image includes at least a binder resin, a colorant, and a releasing agent, wherein the binder resin has at least two kinds of binder resin that have different weight average molecular weights, wherein a peak temperature of a loss tangent (tan δ) of the toner is equal to or greater than 64° C. and less than 70° C., and an average value of the loss tangent (tan δ) at a temperature ranging from 100° C. to 120° C. of the toner is equal to or greater than about 1.5, and is equal to or less than about 2.0 in a dynamic viscoelasticity measurement conducted as a function of temperature under a condition of a measurement frequency of 6.28 rad/s, a heating rate of 2.0° C./min, and an initial strain of 0.3%, where tan 5 is a tangent of a phase angle δ between deformation and response when stress or strain is applied to the toner.

According to an exemplary embodiment of the present general inventive concept, a molecular weight distribution curve of the toner obtained by using a gel permeation chromatography (GPC) method on a tetrahydrofuran (THF) soluble fraction may have a main peak in a molecular weight range of about 10,000 to about 30,000 g/mol and a shoulder-type secondary peak whose shoulder starting point is located in a molecular weight range of about 100,000 to about 600,000 g/mol.

According to an exemplary embodiment of the present general inventive concept, the toner may include about $1.0\times10^3$ ppm to about $1.0\times10^4$ ppm of iron (Fe) and about $1.0\times10^3$ to about $5.0\times10^3$ ppm of silicon (Si).

According to an exemplary embodiment of the present general inventive concept, when a total iron concentration of a toner and an iron concentration present on a surface of the toner determined by X-ray fluorescence (XRF) measurements are denoted as [Fe1] and [Fe2], respectively, the ratio of [Fe2] to [Fe1], i.e., [Fe2]/[Fe1], of the toner may satisfy the following condition: $0.05\leq[Fe2]/[Fe1]\leq0.5$.

According to an exemplary embodiment of the present general inventive concept, the releasing agent may include a paraffin-based wax and an ester-based wax, an amount of the ester-based wax may be about 10 wt % to about 50 wt % based on the total weight of the paraffin-based wax and the ester-based wax, and a difference between a solubility parameter (SP) of the binder resin and a SP of each of the paraffin-based wax and the ester-based wax may be about 2 or more.

According to an exemplary embodiment of the present general inventive concept, the toner may have a core-shell structure including a core layer comprising the binder resin, the colorant, and the releasing agent and a shell layer covering the core layer and comprising the binder resin.

According to another exemplary embodiment, a toner supply device includes a toner tank storing a toner, a supplying part protruding toward an inner side of the toner tank and supplying the stored toner to an outside of the tank, and a toner stirring member rotatably installed inside the toner tank and configured to stir the toner in at least a portion of an inner space of the toner tank including an upper portion of the supplying part, wherein the toner is a toner to develop an electrostatic charge image according to an embodiment of the present general inventive concept, where tan δ is a tangent of a phase angle δ between deformation and response when stress or strain is applied to the toner.

According to another exemplary embodiment, an apparatus forms an image, the apparatus including an image carrier, an image forming device forming a latent image on a surface of the image carrier, a toner storage device for storing a toner, a toner supply device supplying the toner to the surface of the image carrier to develop the latent image to a toner image on the surface of the image carrier, and a toner transfer device transferring the toner image from the surface of the image carrier to an image receiving member, wherein the toner is a toner to develop an electrostatic charge image according to an embodiment of the present general inventive concept, where tan δ is a tangent of a phase angle δ between deformation and response when stress or strain is applied to the toner.

According to another exemplary embodiment, a method of forming an image includes adhering a toner to a surface of an image carrier on which an electrostatic latent image is formed to form a visible image and transferring the visible image to an image receiving member, wherein the toner is a toner to develop an electrostatic charge image, the toner including at least a binder resin, a colorant, and a releasing agent, wherein the binder resin comprises at least two kinds of binder resin having different weight average molecular weights, wherein a peak temperature of a loss tangent (tan δ) of the toner is equal to or greater than 64° C. and less than 70° C. and an average value of the loss tangent (tan δ) at a temperature ranging from 100° C. to 120° C. of the toner is equal to or greater than about 1.5 and equal to or less than about 2.0 in a dynamic viscoelasticity measurement conducted as a function of temperature under a condition of a measurement frequency of 6.28 rad/s, a heating rate of 2.0° C./min, and an initial strain of 0.3%, where tan δ is a tangent of a phase angle δ between deformation and response when stress or strain is applied to the toner.

According to an exemplary embodiment of the present general inventive concept, a toner supply device includes a toner tank having a supplying portion to store and supply a toner to an outside of the tank and a toner stirring member rotatably installed inside the toner tank and configured to stir the toner in at least a portion of an inner space of the toner tank including an upper portion of the supplying part, where the toner is utilized to develop an electrostatic charge image. The toner includes at least a binder resin, a colorant, and a releasing agent. The binder resin includes at least two kinds of binder resin having different weight average molecular weights. A peak temperature of a loss tangent (tan δ) of the toner is equal to or greater than 64° C. and less than 70° C. and an average value of the loss tangent (tan δ) at a temperature ranging from 100° C. to 120° C. of the toner is equal to or greater than about 1.5 and equal to or less than about 2.0 in a dynamic viscoelasticity measurement conducted as a function of temperature under a condition of a measurement frequency of 6.28 rad/s, a heating rate of 2.0° C./min, and an initial strain of 0.3%, where tan δ is a tangent of a phase angle δ between deformation and response when stress or strain is applied to the toner.

According to an exemplary embodiment of the present general inventive concept, an apparatus is utilized to form an image. The apparatus includes an image carrier, an image forming device forming a latent image on a surface of the image carrier, a toner storage device having a supply portion arranged to store and supply a toner to the surface of the image carrier to develop the latent image to a toner image on the surface of the image carrier, and a toner transfer device transferring the toner image from the surface of the image carrier to an image receiving member. The toner is utilized to develop an electrostatic charge image. The toner includes at least a binder resin, a colorant, and a releasing agent. The binder resin includes at least two kinds of binder resin having different weight average molecular weights. A peak temperature of a loss tangent (tan δ) of the toner is equal to or greater than 64° C. and less than 70° C. and an average value of the loss tangent (tan δ) at a temperature ranging from 100° C. to 120° C. of the toner is equal to or greater than about 1.5 and equal to or less than about 2.0 in a dynamic viscoelasticity measurement conducted as a function of temperature under a condition of a measurement frequency of 6.28 rad/s, a heating rate of 2.0° C./min, and an initial strain of 0.3%, where tan δ is a tangent of a phase angle δ between deformation and response when stress or strain is applied to the toner.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Figure 1:
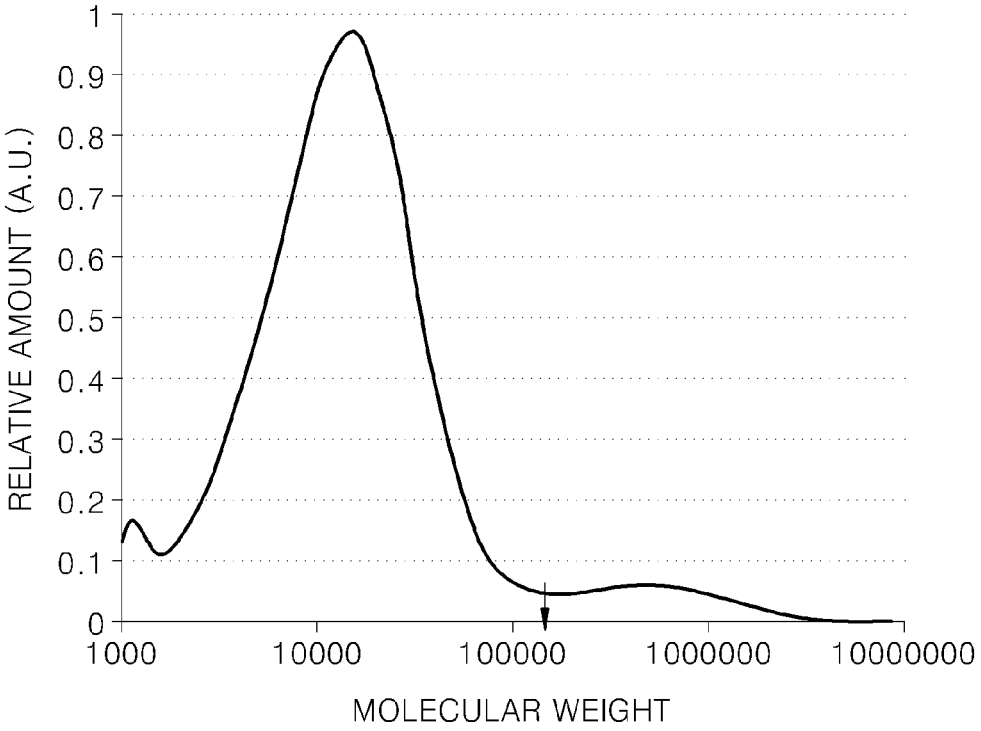
FIG. 1 is a schematic molecular weight distribution curve illustrating a main peak in a reduced molar mass weight range and a shoulder-type secondary peak in an increased molar mass weight range according to exemplary embodiments of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures. As used herein, the term "and/or" includes any and all combinations of one or more of the associated listed items.

Hereinafter, exemplary embodiments of a toner to develop an electrostatic charge image, a method of preparing the toner, a toner supply device, and an apparatus and method to form an image will be described in detail.

A toner to develop an electrostatic charge image according to an embodiment of the present general inventive concept may include a binder resin including at least two resins having different weight average molecular weights, for example, a reduced molar weight binder resin and an increased molar weight binder resin, and a releasing agent having an effective compatibility with the binder resins, so that the toner is effecacious for use in, in particular, a one-component contact development method.

Specifically, a toner to develop an electrostatic charge image, according to an embodiment of the present general inventive concept, includes at least a binder resin, a colorant, and a releasing agent, wherein the binder resin includes two or more kinds of binder resins having different weight average molecular weights. A weight average molecular weight Mw of the reduced molar weight binder resin is in the range of about 10,000 to about 40,000 g/mol, for example, about 15,000 to about 30,000 g/mol, for example, or about 20,000 to about 30,000 g/mol. When the weight average molecular weight Mw of the reduced molar weight binder resin is within these ranges, the strength of the toner particles is improved, resulting in improved durability and fixability. If the weight average molecular weight Mw of the reduced molar weight binder resin is less than about 10,000 g/mol, the strength of the toner particles is ineffective, and thus, the toner may have insufficient durability. On the other hand, if the weight average molecular weight Mw of the reduced molar weight binder resin is greater than about 40,000 g/mol, the fixability of the toner may be insufficient.

A weight average molecular weight Mw of the increased molar weight binder resin is in the range of about 100,000 to about 600,000 g/mol, for example, about 150,000 to about 600,000 g/mol, for example, or about 200,000 to about 400,000 g/mol. When the weight average molecular weight Mw of the increased molar weight binder resin is within these ranges, a broad fixing latitude may be obtained and the durability and gloss of the toner may be improved.

If the weight average molecular weight Mw of the increased molar weight binder resin is less than about 100,000 g/mol, the fixing latitude is reduced, and the durability of the toner may be adversely affected. On the other hand, if the weight average molecular weight Mw of the increased molar weight binder resin is greater than about 600,000 g/mol, the viscosity of the binder resin, thus of the toner, is greater than a predetermined amount, and thus, handling and fixing ability of the toner may be adversely affected.

A weight mixing ratio of the reduced molar weight binder resin to the increased molar weight binder resin may be in the range of about 85 to about 95 wt %: about 5 to about 15 wt %, for example, or about 90 to about 95 wt %: about 5 to about 10 wt %. As the amount of the increased molar weight binder resin having a glass transition temperature that is greater than a predetermined value in the binder resin increases, the elasticity of a finally-obtained toner increases at temperature ranges that are greater than a predetermined value around the fixing temperature. The increased molar weight binder resin contributes to the elasticity of a toner and improves the durability of the toner. If the amount of the increased molar weight binder resin increases, however, the toner may have reduced gloss.

Due to the use of the binder resin described above, a molecular weight distribution curve of the toner obtained by using a gel permeation chromatography (GPC) method on a tetrahydrofuran (THF) soluble fraction may have a main peak (e.g., a main peak is illustrated in FIG. 1) in a molecular weight range of about 10,000 to about 30,000 g/mol and a shoulder-type secondary peak (e.g., a shoulder-type secondary peak is illustrated in FIG. 1) whose shoulder starting point (e.g., a shoulder starting point is illustrated in FIG. 1) is located in a molecular weight range of about 100,000 to about 600,000 g/mol.

As described above, a molecular weight of a toner may affect gloss and fixing properties of the toner, and a molecular weight distribution of a binder resin formed of a polymer resin almost corresponds to a molecular weight distribution of a toner. Accordingly, if one kind of resin is used as a binder resin, a molecular weight distribution curve of a toner has one normal distribution curve. However, if a binder resin, including a reduced molar weight resin and an increased molar weight resin, is used, a molecular weight distribution curve of a toner has a main peak in a range corresponding to the reducee molar weight resin and a shoulder in a range corresponding to the increased molar weight resin, wherein the shoulder indicates a distribution curve portion having a gradual slope connected to an edge of the main peak having a steep slope.

FIG. 1 illustrates a schematic molecular weight distribution curve having a main peak in a reduced molar weight range and a shoulder-type secondary peak in an increased molar weight range. In FIG. 1, a shoulder starting point in the molecular weight distribution curve is indicated by an arrow.

If the amount of the increased molar weight resin is greater than a predetermined value, a double peak may appear. In this case, a toner formed may have reduced gloss although an anti-offset property of the toner is increased. As described above, when a toner is prepared by using an effective ratio of a binder resin including two or more kinds of resins having different weight average molecular weights, the resins may independently perform their functions.

The binder resin according to the present general inventive concept includes a reduced molar weight binder resin having a molecular weight that is less than a critical molecular weight and an increased molar weight binder resin having a molecular weight that is larger than the critical molecular weight at an appropriate ratio. The two kinds of binder resins may independently perform their functions. A reduced molar weight binder resin has entanglements of a predetermined size between its molecular chains, and thus, contributes to minimum fixing temperature (MFT) and gloss. An increased molar weight binder resin has an increased predetermined number of entanglements between its molecular chains, and thus, allows a toner to have a predetermined level of elasticity even at elevated temperatures, thereby contributing to an anti-offset property. As described above, the increased molar weight binder resin and the reduced molar weight binder resin may be mixed at an effective ratio, whereby rheological properties of a toner including a loss tangent, which will be described below, may be precisely controlled. Thus, contamination of elements of an image forming apparatus using a one-component contact development method may be prevented and a toner that is stably provides an increased quality image over an increased period of time may be obtained.

As a result of an effective combination of the increased molar weight binder resin and the reduced molar weight binder resin and effective selection of a releasing agent, a peak temperature of a loss tangent (tan δ) of the toner is equal to or greater than 64° C. and less than 70° C., for example, or equal to or greater than 64° C. and less than 68° C. An average value of the loss tangent (tan δ) at a temperature ranging from 100° C. to 120° C. of the toner is equal to or greater than 1.5 and equal to or less than 2.0, for example, equal to or greater than 1.6 and equal to or less than 2.0 or, for example, or equal to or greater than 1.6 and equal to or less than 1.9, in a dynamic viscoelasticity measurement conducted as a function of temperature. The dynamic viscosity measurement is carried out under a condition of a measurement frequency of 6.28 rad/s, a heating rate of 2.0° C./min, and an initial strain of 0.3%. The loss tangent denotes a ratio (G"/G') of a loss modulus (G") indicating the viscosity of a material to a storage modulus (G') indicating the elasticity of the material. A loss tangent value greater than 1 indicates that viscosity is stronger than elasticity.

Since the increased molar weight binder resin contributes to the elasticity of a toner, the elasticity of the toner increases with an increase in the amount of the increased molar weight binder resin, and thus, a loss tangent value of the toner after glass transition point of the toner binder resin decreases and fixing properties such as a hot-offset property and durability of the toner are improved, whereas gloss of a fixed image is reduced. In contrast, since the reduced molar weight binder resin contributes to the viscosity of a toner, the viscosity of the toner increases with an increase in the amount of the reduced molar weight binder resin, and thus, a loss tangent value of the toner increases and may affect fixing properties such as a hot-offset property and durability of the toner, whereas gloss of a fixed image increases. Therefore, in the present general inventive concept, the loss tangent value of the toner is controlled by an effective ratio of the increased molar weight binder resin and the reduced molar weight binder resin. In other words, when the loss tangent of the toner has a predetermined value range at 85° C. or more, particularly, 100° C. or more, a toner having improved fixing properties and increased gloss while maintaining the durability of an image obtained in one-component contact development may be obtained. Since the loss tangent value may not readily be measured at temperature ranges of 120° C. or more, a loss tangent value at a temperature ranging from 100 to 120° C. is measured, and the measured loss tangent value may be used to examine the properties of the toner.

The increased molar weight binder resin not only contributes to the elasticity of the toner and also improves the durability of the toner. However, if the amount of the increased molar weight binder resin increases, the fixing properties and the gloss of the toner deteriorate. The toner may have development stability, development lifetime, fixing properties, charging stability, gloss, an anti-offset property, and heat storage ability at predetermined levels or higher by controlling dynamic viscoelastic properties of the toner that are represented by the precisely controlled loss tangent (tan δ). Therefore, the toner may stably provide an increased-quality image for an extended period of time without contaminating a one-component contact development type image developing apparatus.

The binder resins may have an identical or different repeating unit as long as the binder resins include two or more kinds of binder resins having different weight average molecular weights. The binder resins may be an addition polymer of a vinyl-based monomer, an acrylic monomer, and/or an olefin-based monomer, polyester, polyamide, or polyimide. Examples of the addition polymer may be a homopolymer or copolymer of at least one polymerizable monomer selected from the group consisting of styrene-based monomers such as styrene, vinyl toluene, and α-methyl styrene, acrylic acid or methacrylic acid, derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylamide, and methacrylamide, acrylonitrile, methacrylonitrile, ethylenically unsaturated mono-olefins such as ethylene, propylene, and butylenes, halogenized vinyl monomers such as vinyl chloride, vinylidene chloride, and vinyl fluoride, vinyl esters such as vinyl acetate and vinyl propionate, vinyl ethers such as vinyl methyl ether and vinyl ethyl ether, vinyl ketones such as vinyl methyl ketone and methyl isoprophenyl ketone, and nitrogen-containing vinyl compounds such as 2-vinylpyridine, 4-vinylpyridine, and N-vinyl pyrrolidone.

The polyester resin may be prepared by reacting a polyhydric alcohol with an aliphatic, a cycloaliphatic, or an aromatic polyvalent carboxylic acid, or alkyl esters thereof through direct esterification or transesterification.

If the polyester resin is a crystalline polyester resin, the crystalline polyester resin may be obtained by reacting an aliphatic polyvalent carboxylic acid having a carbon number of 8 or more (excluding carbons of carboxylic group). For example, a carbon number of 8 to 12 may be utilized, specifically a carbon number of 9 to 10 with a polyhydric alcohol having a carbon number of 8 or more, e.g., a carbon number of 8 to 12, specifically a carbon number of 9 to 10. For example, the crystalline polyester resin may be a polyester resin obtained by reacting 1,9-nonanediol with 1,10-decane dicarboxylic acid, or reacting 1,9-nonanediol with 1,12-dodecanedicarboxylic acid. By reducing the carbon number in the above ranges, the crystalline polyester resin having a melting temperature effective for the toner may be easily obtained, and an affinity with the amorphous polyester resin is obtained by increasing a linearity of the resin chemical structure due to its being an aliphatic polyester resin.

Since the releasing agent increases reduced-temperature fixability, improved final image durability and abrasion resistance of the toner, types and content of the releasing agent are important in determining toner characteristics. The releasing agent may be a natural wax or a synthetic wax. The type of the releasing agent is not limited thereto, but may be selected from the group consisting of a polyethylene-based wax, a polypropylene-based wax, a silicone wax, a paraffin-based wax, an ester-based wax, carnauba wax and a metallocene wax. A melting temperature of the releasing agent may be in the range of about 60° C. to about 100° C., for example, 114 or about 65° C. to about 95° C., specifically about 68° C. to about 92° C. The releasing agents physically adhere to the toner particles, but do not covalently bond with the toner particles.

An amount of the releasing agent may be, for example, about 1 to about 20 wt %, about 5 to about 15 wt %, or about 9 to about 13 wt %, based on a total weight of the toner. If the amount of the releasing agent is 1 wt % or more, a reduced-temperature fixability of the toner is effective and a desired fixing temperature range may be obtained. If the amount of the releasing agent is 20 wt % or less, a storage ability of the toner may be improved and the toner may be economical.

Regarding an oil-less fixing toner, in general, an increased gloss property may be obtained by decreasing a melt viscosity of a toner. However, the melt viscosity may be greater than a predetermined value so as to facilitate peeling or detaching a toner from paper and to suppress a hot offset. As described above, in order to obtain a paper peeling property and an anti-offset property while maintaining increased gloss, a releasing agent is added to an inside of a toner. For this, a releasing agent dispersion is used in an aggregation process to produce a toner. In this case, however, if an amount of the releasing agent used is greater than a predetermined value, the excess releasing agent may contaminate a developing roll, a photoreceptor, and other components of an apparatus to form an image such as a printer.

If a releasing agent having a reduced melting point and reduced viscosity is used to perform reduced-temperature fixing of a toner, an image quality may be decreased due to the presence of the releasing agent on the surface of the toner although the reduced-temperature fixation may be achievable.

If the melting point of the releasing agent is at a level that is less than a predetermined level, the releasing agent is likely to flow out of a surface of the toner due to deterioration during a printing process, thereby causing contamination, such as filming, on a developing member.

In general, a releasing agent is a crystalline polymer having a reduced molar weight, and a viscosity of the polymer is substantially decreased at around a melting point of the polymer to a level that is less than the viscosity of a binder resin.

A coalescing process after the aggregation process is performed generally at a temperature equal to or greater than the melting point of a releasing agent. Thus, in the coalescing process, a distribution structure of the releasing agent in a toner is flowable, and when a centrifugal force caused by stirring or agitation is applied to the releasing agent, the releasing agent migrates inside of the toner due to a reduced viscosity. In these circumstances, the more reduced the viscosity of the releasing agent such as a wax, the wider the distribution size of the releasing agent, and the farther the location of the releasing agent from the surface of the toner.

In order to provide a peelable or detachable property of the toner, which is needed to fix a toner, a distribution size and location of the releasing agent are important. For example, if the releasing agent is located at a distance that is greater than a predetermined distance from the surface of a toner, the releasing agent may not perform its function effectively during fixing, and if the releasing agent is closer than another predetermined distance from the surface of a toner, the releasing agent may cause contamination to a developing member, thereby causing reduced image quality. Accordingly, a releasing agent is selected that has an effective melting point and melt viscosity.

A toner according to an embodiment of the present general inventive concept includes a mixture including a paraffin-based wax and an ester group-containing ester-based synthetic wax, and due to the use of the mixed wax, the toner has an improved detachable property and an increased image stability. That is, a releasing agent used in a toner according to an embodiment of the general inventive concept may include an ester group-containing ester-based wax. Examples of such a releasing agent are (1) a mixture of an ester-based wax and a non-ester-based wax, and (2) an ester group-containing wax prepared by adding an ester group to a non-ester based wax.

Since the ester group has an increased affinity for the binder resin latex component, especially a polyester latex component of the toner, the wax may be uniformly distributed throughout the toner particles to effectively exhibit wax effects. The non-ester-based wax components may suppress excessive plasticization that may occur when only the ester-based wax is present, due to a releasing effect of the latex. As a result, the mixture of ester-based wax and non-ester-based wax may maintain effective developability of the toner for an increased period of time.

Examples of the ester-based wax may include esters of fatty acids having a carbon number of about 15-30 with a mono- to pentavalent aliphatic alcohol, such as behenyl behenate, stearyl stearate, pentaerythritol stearate, glyceryl montanate, etc.

The aliphatic alcohol component constituting the ester may be monovalent alcohol with a carbon number of about 10-30 or polyhydric alcohol with a carbon number of about 3-10. Examples of the non-ester-based wax include a polyethylene-based wax, a polypropylene-based wax, a silicone wax, and a paraffin-based wax.

Examples of the ester group-containing wax may include a mixture of a paraffin-based wax and an ester-based wax, and an ester group-containing paraffin-based wax. A specific example thereof may include P-212, P-280, P-318, P-319, P-419 and P-420 (manufactured by CHUKYO YUSHI CO., LTD.). When the releasing agent is a mixture including a paraffin-based wax and an ester-based wax, an amount of the ester-based wax may be 10 wt % to 50 wt %, for example, or 15 wt % to 50 wt %, based on the total weight of the paraffin-based wax and the ester-based wax. When the amount of the ester-based wax is 10 wt % or more, compatibility of the releasing agent with respect to a binder resin latex may be effectively maintained. When the amount of the ester-based wax is 50 wt % or less, plasticizing characteristics of the toner are effectively controlled, and the toner retains developability for an increased period of time.

In the present toner according to exemplary embodiments of the present general inventive concept, the releasing agent may be selected such that a solubility parameter (SP) value of the binder resin has a difference of about 2 or more when compared with an SP value of the paraffin-based wax and an SP value of the ester-based wax. By selecting a combination of the binder resin and the releasing agent having such SP values, exposure of the releasing agent from the surface of the toner may be suppressed. If the SP difference is less than a predetermined value, a plasticization phenomenon may occur between the binder resin and the releasing agent. The greater the compatibility between the binder resin and the releasing agent, the more reduced the distribution size of the releasing agent inside the toner may be and the nearer the releasing agent is to the surface of the toner. If the compatibility is effective, a gloss property and an anti-offset property of the toner may be improved due to a uniform fixed or fused image and enhanced smoothness of an image. However, if the compatibility is inappropriately controlled, more of the releasing agent is exposed to the surface of the toner and contaminates other components, such as a developing roll, a photoreceptor, and other components of an apparatus to form an image such as a printer.

Due to the addition of a coagulant, the toner may include iron (Fe) and silicon (Si). An amount of Fe in the toner may be, for example, about 1,000 to about 10,000 ppm, or about 2,000 to about 8,000 ppm, or about 4,000 to about 6,000 ppm. An amount of Si in the toner may be, for example, about 1,000 to about 5,000 ppm, or about 1,500 to about 4,500 ppm, or about 2,000 to about 4,000 ppm. If the amounts of Fe and Si are within the ranges described above, the charging property of the toner may be improved and contamination inside an apparatus to form an image may be minimized and/or prevented.

When a total iron concentration of the toner determined by X-ray fluorescence (XRF) measurement and an iron concentration present on a surface of the toner determined by X-ray photoelectron spectroscopy (XPS) are denoted as [Fe1] and [Fe2], respectively, the ratio of [Fe2] to [Fe1], i.e., [Fe2]/[Fe1], of the toner may satisfy the following condition: $0.05 \leq [Fe2]/[Fe1] \leq 0.5$. In this regard, [Fe1], [Fe2], and the [Fe2]/[Fe1] ratio are values measured by XRF and XPS, which will be described below.

The iron concentrations [Fe1] and [Fe2] generally depend on the amount of iron contained in a coagulant used to coagulate a binder resin, a colorant, and a releasing agent used in a process of preparing a toner. When the [Fe2]/[Fe1] ratio is within the ranges described above, the iron atoms may form an ionic cross-link with polar moieties of the binder resin to increase the strength of a fixed image, resulting in improved anti-hot-offset properties. When the [Fe2]/[Fe1] ratio is greater than a predetermined value, it may lead to an increase in melt viscosity, a reduction in gloss of a fixed image, and a decrease in reduced-temperature fixability. That is, by adjusting the amount of a used coagulant to control the concentrations of iron present on a surface of a toner and inside thereof, a toner with coagulating properties, charging properties, reduced-temperature fixability, anti-hot-offset property, and a heat storage ability at effective levels may be obtained.

A volume average diameter of a toner to develop an electrostatic charge image according to an exemplary embodiment of the present general inventive concept may be in the range of about 3 μm to about 9.5 μm. For example, the diameter may be in the range of about 4 μm to about 8.5 μm, and about 4.5 μm to about 7.5 μm. Generally, although one may obtain an increased resolution and an increased quality by decreasing a toner particle size, it may decrease a transfer speed and the facilitation of cleaning. Therefore, an effective diameter is determined. The volume average diameter of the toner may be measured by using an electrical resistance method. When the volume average diameter of the toner is about 3.0 μm or more, photoreceptor cleaning is facilitated, production yield is improved, a scattering of toner particles may be suppressed, and an increased resolution and increased quality image may be obtained. When the volume average diameter of the toner is about 9.5 μm or less, charging is uniform, fixability of the toner is improved, and controlling of a toner layer by a doctor blade is facilitated.

Average circularity of the toner particles to develop an electrostatic charge image according to an exemplary embodiment of the present general inventive concept may be in the range of about 0.940 to about 0.985. For example, the average circularity may be in the range of about 0.945 to about 0.975, or about 0.950 to about 0.970. The average circularity of the toner particles may be calculated by a method that will be described below. A value of circularity is in the range of 0 and 1, and the toner particle becomes more spherically shaped as the value of circularity approaches 1. When the average circularity of the toner particles is about 0.940 or more, toner consumption may be reduced because height of the image developed on a transfer member is appropriate, and sufficient coverage on the image developed on the transfer member may be obtained because voids between the toners are not extensively enlarged. When the average circularity of the toner particles is about 0.985 or less, a supply of the toner that is greater than a predetermined value on a developing sleeve is prevented so that contamination by non-uniform coating on the sleeve with the toner may be reduced.

A volume average particle size distribution index GSDv (Geometric Standard Deviation with respect to volume average particle size) or a number average particle size distribution index GSDp (Geometric Standard Deviation with respect to particle size distribution) as defined below may be used as an index of toner particle size distribution. A measurement method thereof will be described below. GSDv and GSDp values of toner particles to develop an electrostatic charge image according to an exemplary embodiment of the present general inventive concept may be about 1.25 or less and about 1.30 or less, respectively. The GSDv value may be about 1.25 or less, and for example, may be in the range of about 1.10 to about 1.25. The GSDp value may be about 1.30 or less, and for example, may be in the range of about 1.15 to about 1.30. If the values of the GSDv and GSDp satisfy the above ranges, a uniform particle diameter of the toner may be obtained.

The core layer of the toner particles to develop an electrostatic charge image according to an exemplary embodiment of the present general inventive concept may include a colorant. The colorant includes black colorant, cyan colorant, magenta colorant, and yellow colorant, and the like.

The black colorant may be carbon black or aniline black.

The yellow colorant may be a condensation-type nitrogen compound, an isoindolinone compound, an anthraquine compound, an azo metal complex, or an allyl imide compound. In particular, Color Index (C.I.) pigment yellow 12, 13, 14, 17, 62, 74, 83, 93, 94, 95, 109, 110, 111, 128, 129, 147, 168, 180, or the like may be included.

The magenta colorant may be a condensation-type nitrogen compound, an anthraquine compound, a quinacridone compound, a basic dye lake compound, a naphthol compound, a benzo imidazole compound, a thioindigo compound or a perylene compound. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be included.

A copper phthalocyanine compound and derivatives thereof, or an anthraquine compound may be used as the cyan colorant. In particular, C.I. pigment blue 1, 7, 15, 15:1, 15:2, 15:3, 15:4, 60, 62, 66, or the like may be included.

Such colorants may be used alone or by combining to form a mixture of two or more, and are selected by considering color, chroma, luminosity, weather resistance, dispersibility in the toner, and the like.

Any content of the colorant may be used as long as a toner is colored with the colorant to a predetermined degree. For example, the content of the colorant may be in the range of about 0.5 parts by weight to about 15 parts by weight, about 1 part by weight to about 12 parts by weight, or about 2 parts by weight to about 10 parts by weight based on 100 parts by weight of the toner. When the content of the colorant is about 0.5 parts by weight or more based on 100 parts by weight of the toner, a sufficient coloring effect may be obtained. When the content of the colorant is about 15 parts by weight or less, an effective tribo-charge quantity may be provided without significantly increasing the manufacturing cost of the toner.

A toner to develop an electrostatic charge image according to an embodiment of the present general inventive concept may have a core-shell structure including a core layer and a shell layer covering the core layer. The core layer may include a binder resin, a colorant, and a releasing agent, and the shell layer may include, for example, a binder resin. The shell layer may prevent or at least suppress exposure of a colorant or a releasing agent, which exert adverse effects on charging characteristics, contained in the core layer to a surface of the toner, thereby enhancing charging stability and durability of toner particles.

The toner particles to develop an electrostatic charge image according to an exemplary embodiment of the present general inventive concept may have a narrow particle size distribution in which fine particles with the diameter of less than about 3 μm are included may comprise less than about 3 wt %, and coarse particles with the diameter of about 16 μm or more are included may comprise less than about 0.5 wt %.

Hereinafter, a method of preparing a toner, according to an embodiment of the present general inventive concept, will be described.

Specifically, the method of preparing a toner to develop an electrostatic charge image includes: (i) mixing a first binder resin latex, a colorant dispersion, and a releasing agent dispersion to prepare a mixture, wherein the first binder resin includes two or more kinds of binder resins having different weight-average molecular weights; (ii) adding a coagulant to the mixture to form core layer particles including the first binder resin, the colorant, and the releasing agent; and (iii) forming toner particles each having a core layer and a shell layer by adding a second binder resin latex to a dispersion of the core layer particles to form the shell layer including the second binder resin on the surfaces of the core layer particles.

The first binder resin and the second binder resin may be identical to or different from each other. However, a use of the first and second binder resins that are identical to each other is desired in terms of compatibility between the core layer and the shell layer and convenience of manufacturing processes.

First, operation (i) will be described in detail. A first binder resin latex, a colorant dispersion, and a releasing agent dispersion are mixed to prepare a mixture. The first binder resin may include two or more kinds of binder resins having different weight-average molecular weights so as to control a molecular weight, Tg, and rheological characteristics of the toner. As the first binder resin, a polymer of one or more polymerizable monomers or a polyester resin may be used alone or in a combination thereof (hybrid type). If the polymer of one or more polymerizable monomers is used as the first binder resin, a releasing agent, such as a wax, may be used together in a polymerization process to synthesize the polymer, or a releasing agent may be separately mixed with the polymer.

The first binder resin latex may include two or more kinds of binder resins having different weight average molecular weights, that is, at least two kinds of binder resin latex including a reduced molar weight resin latex and an increased molar weight resin latex. A weight ratio of the reduced molar weight resin to the increased molar weight resin is the same as described above. The first binder resin may be prepared such that the reduced molar weight binder resin latex is emulsion-polymerized or dispersed to control its volume average particle size to be in a range of about 100 to 300 nm, and the increased molar weight binder resin latex is emulsion-polymerized or dispersed to control its volume average particle size to be in a range of about 100 to about 300 nm.

If the volume average particle size of each of the reduced molar weight binder resin latex and the increased molar weight binder resin latex is within about 100 to about 300 nm, adjustment of a degree of aggregation of toner particles may be facilitated so as to provide a toner having a desired final particle size.

When the reduced molar weight binder resin and the increased molar weight binder resin as a binder resin are addition polymers of one or more polymerizable monomers, examples of an available polymerizable monomer include styrene-based monomers such as styrene, vinyl toluene and α-methyl styrene, acrylic acid or methacrylic acid, derivatives of (meth)acrylic acid such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylamide and methacryl amide, acrylonitrile, methacrylonitrile, ethylenically unsaturated mono-olefins such as ethylene, propylene and butylenes, halogenized vinyl monomers such as vinyl chloride, vinylidene chloride and vinyl fluoride, vinyl esters such as vinyl acetate and vinyl propionate, vinyl ethers such as vinyl methyl ether and vinyl ethyl ether, vinyl ketones such as vinyl methyl ketone and methyl isoprophenyl ketone, and nitrogen-containing vinyl compounds such as 2-vinylpyridine, 4-vinylpyridine and N-vinyl pyrrolidone.

When an addition polymer is used as the binder resin, a polymerizable monomer may be emulsion-polymerized in an aqueous medium including an emulsifier to prepare a binder resin latex. In this regard, a polymerization initiator and a chain transfer agent may be used to efficiently perform the polymerization reaction.

Examples of the polymerization initiator may include persulfates such as potassium persulfate or ammonium persulfate; azo compounds such as 4,4-azobis(4-cyano valeric acid), dimethyl-2,2'-azobis(2-methylpropionate), 2,2-azobis (2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile), and peroxides such as methyl ethyl ketone peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate, or di-t-butyl peroxyisophthalate. In addition, oxidation-reduction initiators prepared by combining these polymerization initiators and reducing agents may also be used as the polymerization initiator.

A chain transfer agent refers to a chemical compound that transfers the activity of a growing polymer chain to another molecule during a polymerization reaction. Through the use of a chain transfer agent, a degree of polymerization of polymer being synthesized may be reduced and a new growing polymer chain may be initiated. Through the use of a chain transfer agent, a molecular weight distribution may be controlled. An amount of the chain transfer agent may be, for example, about 0.1 to about 5 parts by weight, or about 0.2 to about 3 parts by weight, or about 0.5 to about 2.0 parts by weight, based on 100 parts by weight of one or more polymerizable monomers. If the amount of the chain transfer agent is less than 0.1 parts by weight, a molecular weight of a polymer is greater than a predetermined value, and thus aggregation efficiency may be decreased, and if the amount of the chain transfer agent is greater than 5 parts by weight, a molecular weight of a polymer is less than a predetermined value, and thus a fixing property of the toner may be decreased. Non-limiting examples of the chain transfer agent are sulfur-containing compounds such as dodecanethiol, a thioglycolic acid, a thioacetic acid, or a mercaptoethanol, halocarbons such as carbon tetrachloride, phosphorous acid compounds such as a phosphorous acid or sodium phosphite, hypophosphorous acid compounds such as hypophosphorous acid or sodium hypophosphite, and alcohols such as methyl alcohol, ethyl alcohol, isopropyl alcohol, or n-butyl alcohol.

The first binder resin latex may further include a charge control agent. The charge control agent that may be used in an exemplary embodiment of the present general inventive concept may include a negative charge-type charge control agent or a positive charge-type charge control agent. The negative charge-type charge control agent may include an organic metal complex or a chelate compound such as azo dyes containing chromium or a mono azo metal complex, a salicylic acid compound containing metal such as chromium, iron and zinc, or an organic metal complex of aromatic hydroxycarboxylic acid or aromatic dicarboxylic acid. The positive charge-type charge control agent may include nigrosine, nigrosine modified with a fatty acid metal salt and an onium salt including a quaternary ammonium salt such as tributylbenzylammonium 1-hydroxy-4-naphthosulfonate and tetrabutylammonium tetrafluoroborate, and the like. However, the charge control agent is not limited to these examples and any known charge control agent may be used. These materials may be used alone or in a combination of at least two. Since the charge control agent stably supports the toner on a developing roller by electrostatic force, charging may be performed stably and quickly using the charge control agent.

If polyester is used as the binder resin, a phase inversion emulsification method may be used to produce a polyester latex. For this purpose, a polyester organic solution is first prepared by dissolving the polyester resin in an organic solvent. The organic solvent may be a solvent known in the art, but typically, a ketone solvent such as acetone and methyl ethyl ketone, an aliphatic alcohol solvent such as methanol, ethanol, and isopropanol, or combinations thereof may be used. Subsequently, NaOH, KOH, or ammonium hydroxide aqueous solution are added into the organic solution and stirred. At this time, the added amount of the basic compound is determined so that it will react with the amount of carboxylic groups present in the polyester resin which may be calculated from an acid value of the polyester resin in an equivalent weight basis. A large amount of water is added into the polyester resin organic solution to perform phase inversion emulsification which converts the organic solution into an oil-in-water emulsion. At this time, a surfactant may be further included selectively. The polyester resin latex may be obtained by removing the organic solvent from the obtained emulsion by using a method such as vacuum distillation, and the like. As a result, for example, resin latex (emulsion) including polyester resin particles having an average particle diameter of about 1 μm or less, about 100 to about 300 nm, and about 150 to about 250 nm is obtained.

A solid content of the binder resin latex is not particularly limited, but this may be in the range of about 5 wt % to about 40 wt %, for example, about 15 wt % to about 30 wt %. A reduced molar weight binder resin latex and an increased molar weight binder resin latex each prepared as described above are mixed at a ratio of about 85-95 wt %: about 5-15 wt %, for example, about 90-95 wt %: about 5-10 wt % to prepare the first binder resin latex that functions as a binder resin for the core layer. Alternatively, the reduced molar weight binder resin latex and the increased molar weight binder resin latex may not be mixed in advance, but individually mixed as a portion of the first binder resin latex together with a colorant dispersion and a releasing agent dispersion, etc.

The first binder resin latex thus prepared is mixed with a colorant dispersion and a releasing agent dispersion to prepare a mixture.

The colorant dispersion may be prepared by homogeneously dispersing a composition including colorants such as black, cyan, magenta and yellow and an emulsifier using an ultrasonic homogenizer, micro fluidizer and the like. Types and contents of colorants that may be used are as described above. Such colorants may be used alone or by combining to form a mixture of two or more, and are selected by considering color, chroma, luminosity (brightness), weather resistance, dispersibility in the toner, etc. Any emulsifier that is known in the art may be used as an emulsifier when preparing the colorant dispersion. For example, an anionic reactive emulsifier, a non-ionic reactive emulsifier or a mixture thereof may be used. A specific example of the anionic reactive emulsifier may include HS-10 (Dai-ichi Kogyo, Co., Ltd.) and DOWFAX 2A1 (Rhodia Inc.), etc. A specific example of the non-ionic reactive emulsifier may include RN-10 (Dai-ichi Kogyo, Co., Ltd.).

The releasing agent dispersion includes a releasing agent, water, and an emulsifier. Types and contents of emulsifiers that may be used are as described above. The emulsifier included in the releasing agent dispersion may be an emulsifier that is known in the art like the emulsifier used in the colorant dispersion.

The mixture is prepared by mixing the first binder resin latex, colorant dispersion and releasing agent dispersion, which are obtained as described above. An apparatus such as a homomixer and a homogenizer may be used during preparation of the mixture.

A coagulant can be added to the mixture to form core layer particles including the first binder resin, the colorant, and the releasing agent. In detail, after the first binder resin latex, the colorant dispersion, and the releasing agent dispersion are mixed, a coagulant is added thereto at a pH of about 0.1 to about 4.0, for example, about 1.0 to about 2.0 to form toner particulates having a volume average particle size of about 2.5 μm or less. In detail, a pH of the mixture is adjusted to be about 0.1 to about 4.0 and then, a coagulant is added to the mixture at a temperature equal to or less than the Tg of the binder resin, for example, about 25° C. to about 70° C., or about 35° C. to about 60° C., and then a shear-induced aggregation mechanism is performed thereon by using a homogenizer, etc. to generate a primary aggregated toner. Then, fusing is performed thereon at a temperature of about 30° C. to about 50° C. greater than the Tg of the binder resin to form core layer particles, for example, having a volume average particle size of about 4.5 μm to about 6.5 μm.

Then, in order to form a shell layer including a second binder resin on a surface of each core layer particle, a second binder resin latex is added to a reaction vessel and a pH inside the system is controlled to be about 6 to about 9, for example about 6 to about 8. When a particle size is maintained constant for a predetermined time period, the temperature is increased to about 85° C. to about 100° C., for example, about 90° C. to about 98° C., and the pH is decreased to about 5 to about 6 to perform a coalescence process to produce toner particles.

Examples of the coagulant are NaCl, $MgCl_2$, $MgCl_2 \cdot 8H_2O$, ferrous sulfate, ferric sulfate, ferric chloride, calcium hydroxide, calcium carbonate, and metallic salts containing silicon (Si) and iron (Fe). However, the coagulant is not limited to these examples. An amount of the coagulant may be, for example, about 0.1 to about 10 parts by weight, or 0.5 to 8 parts by weight, or 1 to 6 parts by weight, based on 100 parts by weight of the first binder resin particles. If the amount of the coagulant is less than 0.1 parts by weight, aggregation efficiency may be decreased, and if the amount of the coagulant is greater than 10 parts by weight, a charging property of the toner may be degraded and a particle size distribution may be deteriorated.

Specifically, a toner for developing an electrostatic charge image may be manufactured by using a metallic salt containing silicon (Si) and iron (Fe) as a coagulant. In this case, the prepared toner may include about 1,000 to about 10,000 ppm of Fe and about 1,000 to about 5,000 ppm of Si. If the amounts of Si and Fe are less than a predetermined amount, an effect of adding the coagulant may be negligible If the amounts of Si and Fe are greater than a predetermined value, a charging property of the toner may be degraded and an interior of an apparatus for forming an image, such as a printer, may be contaminated.

In particular, when the metallic salts containing Si and Fe are used, the size of the primary aggregated toner particles will be increased by increased ionic strength and collisions between particles. For example, the metallic salts containing Si and Fe may include a polysilicate iron or "Polysilicato-Iron". The metal salts containing Si and Fe exhibit a strong aggregation force during an aggregating process, environmental stability, no-harm to humans, and uniform control of a particle size and shape of aggregated toner particles.

As a polysilicate iron, for example, PSI-025, PSI-050, PSI-085, PSI-100, PSI-200, and PSI-300 (product names, SUIDO KIKO KAISHA LTD.) may be used. PSI is an abbreviation of "Polysilicato-Iron". Physical properties and compositions thereof are listed in Table 1 below.

TABLE 1

| | | Type | | | | | |
|---|---|---|---|---|---|---|---|
| | | PSI-025 | PSI-050 | PSI-085 | PSI-100 | PSI-200 | PSI-300 |
| Si/Fe molar ratio | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (g/mol) | | about 500,000 | | | | | |
| Appearance | | Yellowish brown transparent liquid | | | | | |

The use of a metallic salt containing Si and Fe as a coagulant in the preparation process of a toner enables production of particles having a size that is less than a predetermined size and a control of a particle shape. A pH of a coagulant solution may be, for example, about 2.0 or less, or for example, about 0.1 to about 2.0. If the pH of the coagulant solution is less than 0.1, the coagulant solution is more acidic than a predetermined level and thus encumbers handling of the coagulant solution. If the pH of the coagulant solution is greater than 2.0, Fe, which is contained in the coagulant, may not control the odor of a chain transfer agent used in preparing a binder resin latex, that is, a sulfur-containing compound, and aggregation efficiency may be decreased.

The second binder resin latex may be identical to the first binder resin latex. Accordingly, all the description presented regarding the first binder resin latex may be applied to the second binder resin latex. A mixed ratio of the reduced molar weight to the high increased molar weight binder resin latex in the second binder resin latex may be identical or different from a mixed ratio of the reduced molar weight to the increased molar weight binder resin latex in the first binder resin latex.

The operations of adding a coagulant to the mixture and forming toner particles include:

(a) aggregating the core layer particles and shell layer particles by adding the coagulant and the second binder resin latex sequentially, and adhering the shell layer particles on the surfaces of the core layer particles in such a temperature range that a shear storage modulus (G') of each of the core layer particle and the shell layer particle is about $1.0\times10^8$ to about $1.0\times10^9$ Pa;

(b) stopping the aggregating reaction when an average size of particles formed in operation (a) is about 70 to about 100% of an average target size of the final toner particles; and (c) coalescing the particles in operation (b) to obtain toner particles in such a temperature range that a shear storage modulus (G') of the particles in operation (b) is about $1.0\times10^4$ to about $1.0\times10^9$ Pa.

In the operation (a) to aggregate the core layer particle and the shell layer particle, physical aggregating is performed. Accordingly, by performing the operation (a) in such a temperature range that a shear storage modulus (G') of each of the core layer particle and the shell layer particle is $1.0\times10^8$ to $1.0\times10^9$ Pa, fusing of the core layer particle and the shell layer particle in advance may be prevented so as to efficiently control a toner particle size distribution.

In the operation (c) to coalesce the particles formed in operation (b) to obtain final toner particles, heating is performed in such a temperature range that a shear storage modulus (G') of the obtained particles in operation (b) is $1.0\times10^4$ to $1.0\times10^9$ Pa, that is, a temperature range of about 10 to about 30° C. greater than a melting point of the particles formed in operation (b). That is, the second binder resin latex that functions as a shell layer is added to the core layer particles, a pH of the reaction system is adjusted to be about 6 to about 9, and when a particle size is maintained constant for a predetermined period of time, the temperature is increased to a range of about 85° C. to about 100° C., for example, about 90° C. to about 98° C., and the pH is reduced to about 5 to about 6 to the particles formed in operation (b), thereby completing preparation of toner particles.

The toner particles may be coated with a third binder resin latex including a polymer of one or more polymerizable monomers as described above and/or polyester. The third binder resin latex may be identical to the first binder resin latex. Accordingly, all the description presented regarding the first binder resin latex may be applied to the third binder resin latex. A mixed ratio of the reduced molar weight to the increased molar weight binder resin latex in the third binder resin latex may be identical or different from a mixed ratio of the reduced molar weight to the increased molar weight binder resin latex in the first binder resin latex.

By forming a shell layer using the second binder resin or the second binder resin and the third binder resin, durability of a toner is increased and storage ability of a toner during shipping and handling may be improved. In this regard, a polymerization inhibitor to minimize and/or prevent formation of new binder resin particles may be additionally added thereto, and the formation process may be performed under starved-feeding conditions so as to sufficiently coat toner particles with a mixture of polymerizable monomers.

The obtained toner particles are filtered, separated, and dried. An external additive may be externally added to the dried toner particles and a charge quantity, etc. is adjusted, thereby producing a final dry toner.

The external additive may be a silicon-containing particle or a titanium-containing particle.

The silicon-containing particle may include a large-size silicon-containing particle having a volume average particle size of about 30 nm to about 100 nm and a reduced-size silicon-containing particle having a volume average particle size of about 5 nm to about 20 nm. The silicon-containing particle may be silica, but is not limited thereto. The reduced-size silicon-containing particle and the increased-size silicon-containing particle are added to provide a property of being negatively-charged and effective fluidity to toner particles, and may be prepared from halogenated silicon through a drying method or from a silicon compound through a wet method in which silica particles are precipitated in a liquid medium. The increased-size silicon-containing particle may have a volume average particle size of about 30 nm to about 100 nm, and may facilitate separation characteristics between toner mother particles in which the toner mother particle refers to a toner to which an external additive is not externally added. The reduced-size silicon-containing particle may have a volume average particle size of about 5 nm to about 20 nm and may provide effective fluidity to toner particles. An amount of the increased-size silicon-containing particle may be, for example, about 0.1 to about 3.5 parts by weight, or about 0.5 to about 3.0 parts by weight, or about 1.0 to about 2.5 parts by weight, based on 100 parts by weight of the toner mother particle. If the amount of the large-size silicon-containing particle is within about 0.1 to about 3.5 parts by weight, a fixing property of the toner may be improved, and over-charging and contamination, and filming may be prevented or suppressed. An amount of the reduced-size silicon-containing particle may be, for example, about 0.1 to about 2.0 parts by weight, or about 0.3 to about 1.5 parts by weight, or about 0.5 to about 1.0 parts by weight, based on 100 parts by weight of the toner mother particle. If the amount of the reduced-size silicon-containing particle is within about 0.1 to about 2.0 parts by weight, a fixing property of the toner may be improved and over-charging and ineffective cleaning may be prevented or suppressed.

An example of the titanium-containing particle may be titanium dioxide, but is not limited thereto. The titanium-containing particle may increase a charging amount and may have excellent environmental characteristics. In particular, a problem of charge-up occurring at a temperature that is less than a predetermined value and in a humidity that is less than a predetermined value may be prevented or suppressed, and a problem of charge-down occurring at a temperature that is greater than a predetermined value and a humidity that is greater than a predetermined value may be minimized, prevented or suppressed. The titanium-containing particle may improve fluidity of toner, and due to the titanium-containing particle, an improved transfer efficiency may be sustained even when producing large amounts of printed materials for an extended period of time. A volume average particle size of the titanium-containing particle may be about 10 nm to about 200 nm. An amount of the titanium-containing particle may be, for example, about 0.1 to about 2.0 parts by weight, or about 0.3 to about 1.5 parts by weight, or about 0.5 to about 1.0 parts by weight, based on 100 parts by weight of the toner mother particle. If the amount of the titanium-containing particle is within about 0.1 to about 2.0 parts by weight, a charging maintenance property with respect to environmental conditions may be improved, and image staining and a decrease in charging amount may be prevented.

According to another embodiment of the present general inventive concept, a method of forming an image includes adhering a toner to a surface of an image carrier on which an electrostatic latent image is formed to form a visible image and transferring the visible image to an image receiving member, where the toner is a toner to develop an electrostatic charge image according to the present general inventive concept.

An electrophotographic image forming process includes a series of operations including the operations of charging, image-wise exposure to light, developing, transferring, fixing, cleaning and erasure to form an image on an image receiving member.

In the charging operation, a surface of an image carrier such as photoreceptor is charged with one of desired polarities, i.e., negative or positive charge, by a corona charging device or a charge roller. In the exposing operation, an optical system, conventionally a laser scanner or an array of diodes, forms a latent image by selectively discharging the charged surface of the image carrier in an imagewise manner corresponding to a target image formed on a final image receiving member. Electromagnetic radiation, originated from the laser scanner or array of diodes and referred to as "light," may include infrared irradiation, visible light irradiation, or ultraviolet irradiation.

In the developing operation, toner particles with effective polarity generally contact the latent image on the image carrier, and conventionally, an electrically-biased developer having identical potential polarity to the toner polarity is used. The toner particles move to the image carrier and selectively adhere to the latent image by electrostatic force to form a toner image on the image carrier.

In the transferring operation, the toner image is transferred to the final image receiving member from the image carrier. An intermediate transferring member which receives the toner image from the image carrier and subsequently transfers it to the final image receiving member is sometimes used.

In the fixing operation, the toner particles are softened or melted by heating the toner image on the final image receiving member, thereby fixing the toner image to the final image receiving member. Another fixing method is to fix the toner on the final image receiving member under increased pressure with or without application of heat.

In the cleaning operation, residual toner remaining on the image carrier is removed.

Finally, in the erasure operation, charges of the image carrier are exposed to light of a specific wavelength band and are reduced to a substantially uniform reduced value. Therefore, a residue of the latent image is removed and the image carrier is prepared for a next image forming cycle.

According to another embodiment of the present general inventive concept, a toner supply device includes a toner tank storing a toner, a supplying part protruding toward an inner side of the toner tank and supplying the stored toner to outside the tank, and a toner stirring member rotatably installed inside the toner tank and configured to stir the toner in at least a portion of an inner space of the toner tank including an upper portion of the supplying part, wherein the toner is to develop an electrostatic charge image.

Figure 2:
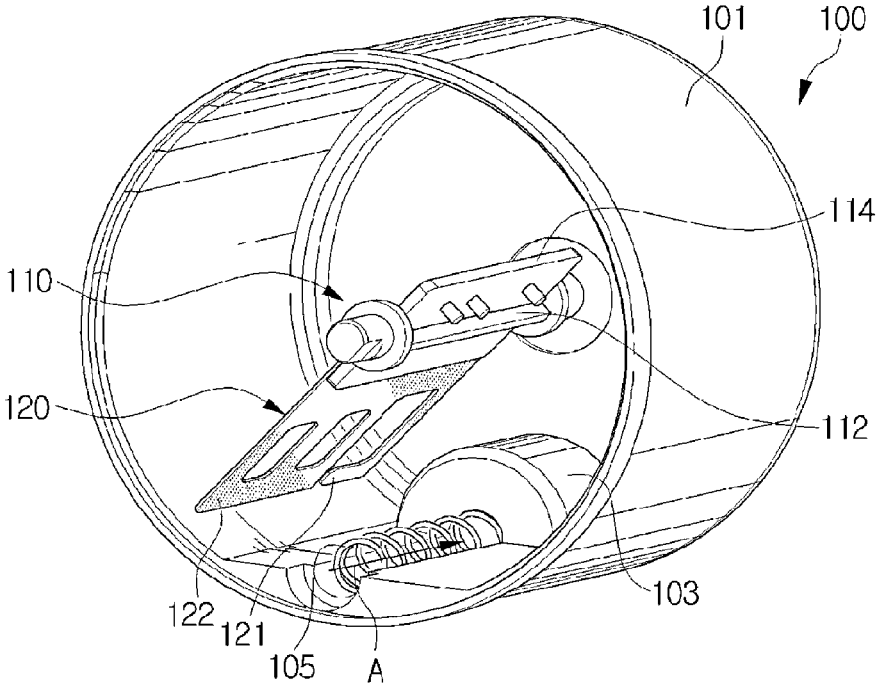
FIG. 2 illustrates a perspective view of a toner supply device according to an exemplary embodiment of the present general inventive concept.

FIG. 2 is a perspective view of a toner supply device 100 according to an exemplary embodiment of the present general inventive concept. Referring to FIG. 2, the toner supplying apparatus 100 includes a toner tank 101, a supplying part 103, a toner conveying member 105, and a toner stirring member 110. The toner supply device 100 may be included in a non-contact type developing apparatus, such as a non-contact type developing apparatus 300 illustrated in FIG. 3 and described below.

The toner tank 101 of the toner supply device 100 stores a predetermined amount of toner and is generally formed in a hollow cylindrical shape.

The supplying part 103 is installed at an inner lower part of the toner tank 101 and discharges the toner stored in the toner tank 101 to the outside of the toner tank 101. That is, the supplying part 103 may protrude from a bottom of the toner tank 101 to the inside of the toner tank 101 in a pillar shape having a semi-circular section. The supplying part 103 includes a toner outlet to discharge the toner to an outer surface thereof.

The toner conveying member 105 is installed at a side of the supplying part 103 at the inner lower part of the inside of the toner tank 101. The toner conveying member 105 is formed in a coil spring shape. Since an end of the toner conveying member 105 extends to an inner side of the supplying part 103, the toner in the toner tank 101 is conveyed to the inner side of the supplying part 103 when the toner conveying member 105 rotates about the A axis. The toner conveyed by the toner conveying member 105 is discharged to the outside through the toner outlet in a direction indicated by arrow A.

The toner stirring member 110 is rotatably installed inside the toner tank 101 and forces the toner in the toner tank 101 to move in a radial direction. That is, when the toner stirring member 110 rotates at a middle of the toner tank 101, the toner in the toner tank 101 is stirred to prevent the toner from solidifying. Then, the toner moves down to the bottom of the toner tank 101 by its own weight. The toner stirring member 110 includes a rotation shaft 112 and a toner stirring film 120. The rotation shaft 112 is rotatably installed at the middle of the toner tank 101 and has a driving gear coaxially installed at an end of the rotation shaft 112 protruding toward a side of the toner tank 101. Therefore, the driving gear and the rotation shaft 112 may rotate as one unit. Also, the rotation shaft 112 may have a wing plate 114 to help fix the toner stirring film 120 to the rotation shaft 112. In general, the wing plate 114 may be symmetrically formed about the rotation shaft 112.

The toner stirring film 120 has a width corresponding to the inner length of the toner tank 101, and may be elastically deformed along a protrusion at an inner side of the toner tank 101, i.e., the supplying part 103. Portions of the toner stirring film 120 may be cut off from an end of the toner stirring film 120 toward the rotation shaft 112 to form a first stirring part 121 and a second stirring part 122.

Figure 3:
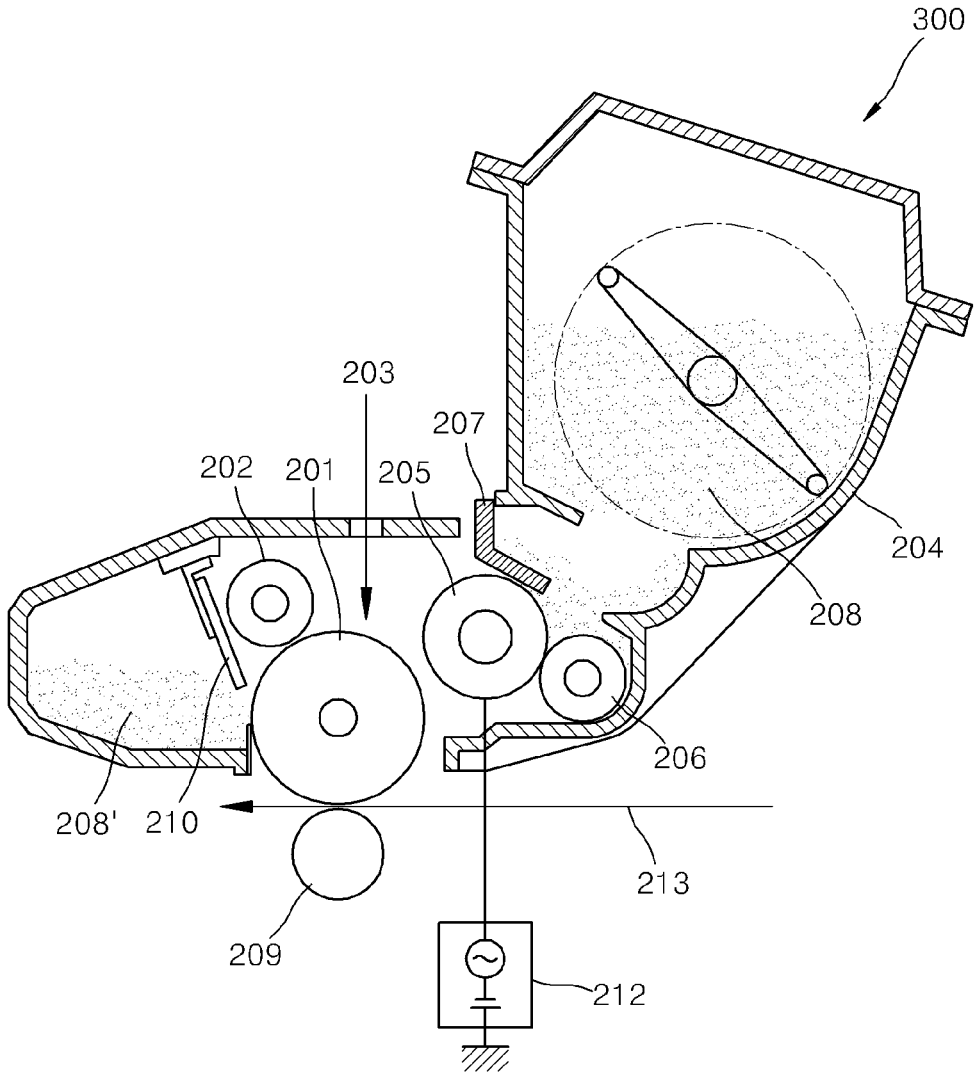
FIG. 3 illustrates an example of an apparatus to form an image containing a toner prepared according to exemplary embodiments of the present general inventive concept.

FIG. 3 is a view illustrating an example of a non-contact development type apparatus 300 to form an image including a toner according to another embodiment of the present general inventive concept, and an operating principle thereof will be described below.

A nonmagnetic one-component developer, i.e., a toner, 208 in a developing device 204, i.e., a toner 208, is supplied on a developing roller 205 by a supplying roller 206 formed of an elastic material, such as polyurethane foam or sponge, etc. The developing device 204 that supplies toner 208 may be part of the toner supply device 100, as described above and illustrated in FIG. 2. The toner 208 supplied on the developing roller 205 reaches a contact portion between a developer controlling blade 207 and the developing roller 205 according to the rotation of the developing roller 205. The developer controlling blade 207 may be formed of an elastic material, such as metal or rubber, etc. When the toner 208 passes through the contact portion between the developer controlling blade 207 and the developing roller 205, the toner 208 is controlled and formed into a thin layer having uniform thickness, and may be effectively charged. The thin-layered toner 208 is transferred to a development region in which the toner 208 is developed on a latent image of a photoreceptor 201, which is an example of an image carrier, by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates in a clockwise direction.

The toner 208, which has been transferred to the development region of the photoreceptor 201, develops the latent image formed on the photoreceptor 201 by an electric force generated by a potential difference between a direct current (DC) biased alternating current (AC) voltage applied by a power source 212 to the developing roller 205 and a potential of the latent image on the photoreceptor 201 charged by a charging device 202. As a result, the toner 208 may form a toner image.

The toner 208 developed on the photoreceptor 201 reaches a position of a transfer device 209 according to the rotation direction of the photoreceptor 201. An image is formed by transferring the toner 208 developed on the photoreceptor to a printing paper 213, i.e., an image receiving member, by corona discharging or the transfer device 209 having a roller shape to which a voltage that is greater than a predetermined value with a polarity opposite to the toner 208 is applied, while the printing paper 213 passes between the photoreceptor 201 and the transfer device 209.

The image transferred to the printing paper 213 passes through an increased temperature and an increased-pressure fixing device, and the image is fixed by fusing the toner 208 to the printing paper. Meanwhile, a non-developed residual toner 208' on the developing roller 205 is collected by the supplying roller 206 in contact with the developing roller 205, and the non-developed residual toner 208' on the photoreceptor 201 is collected by a cleaning blade 210. The processes described above are repeatedly performed.

The present inventive concept will now be described in further detail with reference to the following examples. These examples are for illustrative purposes only and are not intended to limit the scope of the present inventive concept.

Preparation Example 1

Preparation of Latex-1

A polymerizable monomer mixture (791 g of styrene and 210 g of n-butyl acrylate), 30 g of β-carboxyethylacrylate (Sipomer, Rhodia), 14.3 g of 1-dodecanethiol acting as a chain transfer agent (CTA), and 437 g of sodium dodecyl sulfate (Aldrich) aqueous solution (2 wt % based on the weight of water) as an emulsifier were loaded into a 3 liter beaker, and the mixture was stirred to prepare a polymerizable monomer-emulsified solution. Separately, 16 g of ammonium persulfate (APS) as an initiator and 700 g of sodium dodecyl sulfate (Aldrich) aqueous solution (0.4 wt % based on the weight of water) as an emulsifier were loaded into a 3 L double-jacketed reactor heated to a temperature of about 75° C. and the polymerizable monomer-emulsified solution separately prepared as described above was slowly added thereto dropwise for 4 hours while stirring. The reaction was performed for 8 hours at a reaction temperature of about 75° C. A particle size of the prepared resin latex was measured by using a light scattering type particle size analyzer (MICROTRAC Company, model name: MICROTRAC S3500 Particle Analyzer), and the particle size was about 180 nm to about 200 nm. A solids content of the latex measured by using a loss-on-drying method was about 42 wt %. A weight average molecular weight Mw of the latex measured by using a GPC method on a THF soluble fraction was about 25,000 g/mol. A glass transition temperature of the latex measured by using a differential scanning calorimeter (PERKINELMER Company, model name: DSC-6) in a second heating curve at a heating rate of 10° C./min was about 60° C.

Preparation Example 2

Preparation of Latex-2

A polymerizable monomer mixture (730 g of styrene and 270 g of n-butyl acrylate), 30 g of β-carboxyethylacrylate (Sipomer, Rhodia), and 437 g of sodium dodecyl sulfate (Aldrich) aqueous solution (2 wt % based on the weight of water) as an emulsifier were loaded into a 3 L beaker, and the mixture was stirred to prepare a polymerizable monomer-emulsified solution. Separately, 5 g of APS as an initiator and 700 g of sodium dodecyl sulfate (Aldrich) aqueous solution (0.4 wt % based on the weight of water) as an emulsifier were loaded into a 3 L double-jacketed reactor heated to a temperature of about 70° C. and the polymerizable monomer-emulsified solution separately prepared as described above was slowly added thereto dropwise for 4 hours or more while stirring. The reaction was performed for 8 hours at a reaction temperature of about 70° C. A particle size of the prepared resin latex was measured by using a light scattering type particle size analyzer (MICROTRAC Company, model name: MICROTRAC S3500 Particle Analyzer), and the particle size was about 180 nm to about 200 nm. A solids content of the latex measured by using a loss-on-drying method was about 42 wt %. A weight average molecular weight Mw of the latex measured by using a GPC method on a THF soluble fraction was about 320,000 g/mol. A glass transition temperature of the latex measured by using a differential scanning calorimeter (PERKINELMER Company, model name: DSC-6) in a second heating curve at a heating rate of 10° C./min was about 60° C.

Preparation Example 3

Preparation of Latex-3

A polymerizable monomer mixture (761 g of styrene and 240 g of n-butyl acrylate), 30 g of β-carboxyethylacrylate (Sipomer, Rhodia), 2.6 g of 1-dodecanethiol acting as a chain transfer agent, and 437 g of sodium dodecyl sulfate (Aldrich) aqueous solution (2 wt % based on the weight of water) as an emulsifier were loaded into a 3 L beaker, and the mixture was stirred to prepare a polymerizable monomer-emulsified solution. Separately, 16 g of APS as an initiator and 700 g of sodium dodecyl sulfate (Aldrich) aqueous solution (0.4 wt % based on the weight of water) as an emulsifier were loaded into a 3 L double-jacketed reactor heated to a temperature of about 75° C. and the polymerizable monomer-emulsified solution separately prepared as described above was slowly added thereto dropwise for 4 hours or more while stirring. The reaction was performed for 8 hours at a reaction temperature of about 75° C. A particle size of the prepared resin latex was measured by using a light scattering type particle size analyzer (MICROTRAC Company, model name: MICROTRAC S3500 Particle Analyzer), and the particle size was about 180 nm to about 200 nm. A solids content of the latex measured by using a loss-on-drying method was about 42 wt %. A weight average molecular weight Mw of the latex measured by using a GPC method on a THF soluble fraction was about 65,000 g/mol. A glass transition temperature of the latex measured by using a differential scanning calorimeter (PERKINELMER Company, model name: DSC-6) in a second heating curve at a heating rate of 10° C./min was about 60° C.

Preparation Example 4

Preparation of Latex-4

A polymerizable monomer mixture (700 g of styrene and 300 g of n-butyl acrylate), 30 g of β-carboxyethylacrylate (Sipomer, Rhodia), 14.3 g of 1-dodecanethiol acting as a chain transfer agent, and 437 g of sodium dodecyl sulfate (Aldrich) aqueous solution (2 wt % based on the weight of water) as an emulsifier were loaded into a 3 L beaker, and the mixture was stirred to prepare a polymerizable monomer-emulsified solution. Separately, 16 g of APS as an initiator and 700 g of sodium dodecyl sulfate (Aldrich) aqueous solution (0.4 wt % based on the weight of water) as an emulsifier were loaded into a 3 L double-jacketed reactor heated to a temperature of about 75° C. and the polymerizable monomer-emulsified solution separately prepared as described above was slowly added thereto dropwise for 4 hours while stirring. The reaction was performed for 8 hours at a reaction temperature of about 75° C. A particle size of the prepared resin latex was measured by using a light scattering type particle size analyzer (MICROTRAC Company, model name: MICROTRAC S3500 Particle Analyzer), and the particle size was about 180 nm to about 200 nm. A solids content of the latex measured by using a loss-on-drying method was about 42 wt %. A weight average molecular weight Mw of the latex measured by using a GPC method on a THF soluble fraction was about 45,000 g/mol. A glass transition temperature of the latex measured by using a differential scanning calorimeter (PERKINELMER Company, model name: DSC-6) in a second heating curve at a heating rate of 10° C./min was about 53° C.

Preparation Example 5

Preparation of Cyan Pigment Dispersion 10 g of sodium dodecyl sulfate (Aldrich) as an anionic reactive emulsifier was loaded into a milling bath together with 60 g of cyan pigment (PB 15:4), and 400 g of glass beads having a diameter of about 0.8 to about 1 mm were added thereto and milling was performed thereon at room temperature. Then, pigment dispersion was further performed by using an ultrasonic wavelength disperser (Sonic and Materials, VCX750) to prepare a colorant dispersion. A pigment dispersion diameter was measured by using a light scattering type particle size analyzer (MICROTRAC S3500) and the diameter was about 180 to about 200 nm. A solids content of the prepared cyan pigment dispersion was about 18.5 wt %.

Preparation Example 6

Preparation of Magenta Pigment Dispersion

A magenta pigment dispersion was prepared in the same manner as in Preparation Example 5, except that Magenta pigment (P122) was used instead of the cyan pigment (PB 15:4) as a colorant. A pigment dispersion diameter was measured by using a light scattering type particle size analyzer (MICROTRAC S3500) and the diameter was about 180 to about 200 nm. A solids content of the prepared magenta pigment dispersion was about 18.5 wt %.

Preparation Example 7

Preparation of Yellow Pigment Dispersion

A yellow pigment dispersion was prepared in the same manner as in Preparation Example 5, except that Yellow pigment (PY74) was used instead of the cyan pigment (PB 15:4) as a colorant. A pigment dispersion diameter was measured by using a light scattering type particle size analyzer (MICROTRAC S3500) and the diameter was about 180 to about 200 nm. A solids content of the prepared yellow pigment dispersion was about 18.5 wt %.

Preparation Example 8

Preparation of Black Pigment Dispersion

A black pigment dispersion was prepared in the same manner as in Preparation Example 5, except that Carbon black (Regal 330) was used instead of the cyan pigment (PB 15:4) as a colorant. A pigment dispersion diameter was measured by using a light scattering type particle size analyzer (MICROTRAC S3500) and the diameter was about 180 to about 200 nm. A solids content of the prepared black pigment dispersion was about 18.5 wt %.

Preparation Example 9

Releasing Agent Dispersion

P-420 obtained from CHUKYO YUSHI CO., LTD., was used as a releasing agent dispersion in the following Examples and Comparative Examples. The releasing agent dispersion is a dispersion of a mixture including a paraffin-based wax and an ester-based wax so as to be appropriately compatible with a binder resin.

Example 1

Preparation of Toner 3,000 g of deionized water, 1,137 g of a mixture including as a core latex 91.5 wt % of the prepared Latex-1 and 8.5 wt % of the prepared Latex-2, 195 g of the cyan pigment dispersion prepared according to Preparation Example 5, and 237 g of P-420 (CHUKYO YUSHI CO., LTD, about 30.5 wt % of a solids content) as a wax dispersion were loaded into a 7 L reactor. 364 g of nitric acid (concentration of 0.3M), and 182 g of PSI-100 (SUIDO KIKO KAISHA LTD.) as a coagulant were added to the mixture and stirred by using a homogenizer at a rotational rate of about 11,000 rpm for 6 minutes to prepare core layer particles having a volume average particle size of about 1.5 to about 2.5 μm.

The resultant mixture was loaded into a 7 L double-jacketed reactor and the temperature was increased from room temperature to about 55° C. (5° C. below the Tg of the latex) at a heating rate of 0.5° C./min. When the average particle size reached about 6.0 μm, 442 g of a latex mixture as a shell latex (a mixture of 91.5 wt % of the Latex-1 and 8.5 wt % of the Latex-2) was slowly added thereto for 20 minutes, and when a volume average particle diameter D50v reached about 6.8 μm, an NaOH aqueous solution (concentration of 1 M) was added thereto to control a pH to be about 7. When the volume average particle diameter D50v was maintained constant for 10 minutes, the temperature was increased to about 96° C. at a heating rate of 0.5° C./min. When the temperature reached about 96° C., nitric acid was added to control a pH to be about 6.0 to coalesce particles for 3 to 5 hours, thereby producing a potato-shaped second aggregated toner having a volume average particle size of about 6.5 to about 7.0 μm. Then, the resultant aggregated reaction solution was cooled to a temperature of about 30 to about 40° C. and filtered to isolate toner particles, and the toner particles were dried.

External additives were added to the toner particles by adding about 100 g of the dried toner particles, about 0.5 g of NX-90 (NIPPON AEROSIL), about 1.0 g of RX-200 (NIPPON AEROSIL), and about 0.5 g of SW-100 (TITAN KOGYO) in a mixer (KM-LS2K, DAE WHA TECH.), and stirring the toner particles and the external additives at about 8,000 rpm for about 4 minutes. As a result, a toner having the volume average particle size of about 6.5 to about 7.0 μm was obtained. Values of GSDp and GSDv of the toner particles were about 1.282 and about 1.217, respectively. Also, average circularity of the toner was about 0.971.

Example 2

A toner was prepared in the same manner as in Example 1, except that the magenta pigment dispersion prepared according to Preparation Example 6 was used as a pigment dispersion instead of the cyan pigment dispersion. Values of GSDp and GSDv of the toner particles were about 1.268 and about 1.223, respectively. Also, average circularity of the toner was about 0.974.

Example 3

A toner was prepared in the same manner as in Example 1, except that the yellow pigment dispersion prepared according to Preparation Example 7 was used as a pigment dispersion instead of the cyan pigment dispersion. Values of GSDp and GSDv of the toner particles were about 1.271 and about 1.219, respectively. Also, average circularity of the toner was about 0.974.

Example 4

A toner was prepared in the same manner as in Example 1, except that the carbon black pigment dispersion prepared according to Preparation Example 8 was used as a pigment dispersion instead of the cyan pigment dispersion. Values of GSDp and GSDv of the toner particles were about 1.271 and about 1.219, respectively. Also, average circularity of the toner was about 0.974.

Example 5

A toner was prepared in the same manner as in Example 4, except that a mixture of 90 wt % of the Latex-1 and 10 wt % of the Latex-2 was used as a core latex and a shell latex. Values of GSDp and GSDv of the toner particles were about 1.2549 and about 1.2202, respectively. Also, average circularity of the toner was about 0.973.

Comparative Example 1

A toner was prepared in the same manner as in Example 4, except that a mixture of 95 wt % of the Latex-1 and 5 wt % of the Latex-2 was used as a core latex and a shell latex. Values of GSDp and GSDv of the toner particles were about 1.2577 and about 1.2181, respectively. Also, average circularity of the toner was about 0.975.

Comparative Example 2

A toner was prepared in the same manner as in Example 4, except that a mixture of 85 wt % of the Latex-1 and 15 wt % of the Latex-2 was used as a core latex and a shell latex. Values of GSDp and GSDv of the toner particles were about 1.2772 and about 1.2394, respectively. Also, average circularity of the toner was about 0.974.

Comparative Example 3

A toner was prepared in the same manner as in Example 4, except that 100 wt % of the Latex-3 was used as a core latex and a shell latex. Values of GSDp and GSDv of the toner particles were about 1.2583 and about 1.2262, respectively. Also, average circularity of the toner was about 0.974.

Comparative Example 4

A toner was prepared in the same manner as in Example 4, except that 100 wt % of the Latex-1 was used as a core latex and a shell latex. Values of GSDp and GSDv of the toner particles were about 1.2621 and about 1.2202, respectively. Also, average circularity of the toner was about 0.975.

Comparative Example 5

A toner was prepared in the same manner as in Example 4, except that a mixture of 91.5 wt % of the Latex-4 and 8.5 wt % of the Latex-2 was used as a core latex and a shell latex. Values of GSDp and GSDv of the toner particles were about 1.2518 and about 1.2194, respectively. Also, average circularity of the toner was about 0.974.

Tables 2 and 3 below show physical properties of the toners prepared according to Examples 1 to 5 and Comparative Examples 1 to 5 measured by using evaluation methods described below.

TABLE 2

| | Color | Tan δ peak temperature (° C.) | Tan δ peak value | Molecular weight corresponding to main peak in GPC molecular weight distribution curve (g/mol) | Molecular weight corresponding to shoulder-type secondary peak starting point in GPC molecular weight distribution curve (g/mol) | Average value of tan δ at a range of 100° C. to 120° C. |
|---|---|---|---|---|---|---|
| Example 1 | Cyan | 67.107 | 2.4199 | 22,500 | 226,000 | 1.7023 |
| Example 2 | Yellow | 67.119 | 2.5335 | 22,800 | 232,000 | 1.8899 |
| Example 3 | Magenta | 67.107 | 2.3745 | 22,600 | 235,000 | 1.7513 |
| Example 4 | Black | 67.104 | 2.3745 | 22,300 | 222,000 | 1.6997 |
| Example 5 | Black | 67.115 | 2.5858 | 22,300 | 235,000 | 1.6449 |
| Comparative Example 1 | Black | 67.099 | 2.3711 | 22,800 | 209,000 | 2.1234 |
| Comparative Example 2 | Black | 67.116 | 2.2448 | 22,500 | 229,000 | 1.0657 |
| Comparative Example 3 | Black | 67.104 | 2.3929 | 53,000 | — | 1.3381 |
| Comparative Example 4 | Black | 67.099 | 2.6628 | 22,400 | — | 2.5019 |
| Comparative Example 5 | Black | 64.110 | 2.5314 | 43,000 | — | 1.4164 |

TABLE 3

| | Color | Filming occurrence point (number of copies) | Streak occurrence point (number of copies) | Development lifetime | MFT (° C.) | HOT (° C.) | Degree of gloss | Heat storage property |
|---|---|---|---|---|---|---|---|---|
| Example 1 | Cyan | 7,000 | 7,000 | ○ | 162 | 210 | 9.0 | ○ |
| Example 2 | Yellow | 7,000 | 7,000 | ○ | 162 | 210 | 9.0 | ○ |
| Example 3 | Magenta | 7,000 | 7,000 | ○ | 161 | 210 | 9.0 | ○ |
| Example 4 | Black | 7,000 | 7,000 | ○ | 163 | 210 | 9.0 | ○ |
| Example 5 | Black | 7,000 | 7,000 | ○ | 162 | No occurrence | 7.5 | ○ |
| Comparative Example 1 | Black | 3,000 | 3,000 | X | 160 | 190 | 11.8 | ○ |
| Comparative Example 2 | Black | 7,000 | 7,000 | ○ | 161 | No occurrence | 4.2 | ○ |
| Comparative Example 3 | Black | 6,000 | 6,000 | ○ | 174 | 200 | 7.0 | ○ |
| Comparative Example 4 | Black | 1,000 | 1,000 | X | 160 | 165 | 12.5 | ○ |
| Comparative Example 5 | Black | 5,000 | 4,000 | Δ | 160 | No occurrence | 8.1 | Δ |

Referring to Tables 2 and 3, it was confirmed that the toners of Examples 1 to 5 satisfying such conditions that a peak temperature of tan δ is in a range of 64° C. to 70° C. and an average value of tan δ at a range of 100° C. to 120° C. is equal to or greater than 1.5 and equal to or less than 2.0 had developing stability, development lifetime, fixability, gloss, and heat storage properties at predetermined levels or higher. The toners of Comparative Examples 2, 3 and 5 in which an average value of tan δ at a range of 100° C. to 120° C. is less than 1.5 had roughly effective developing stability and developing lifetime, but had reduced gloss. In contrast, the toners of Comparative Examples 1 and 4 in which an average value of tan δ at a range of 100° C. to 120° C. is greater than 2.0 had effective gloss, but had reduced developing stability and developing lifetime.

From the results, it was confirmed that the average value of tan δ at a range of 100° C. to 120° C. should be in the range of equal to or greater than 1.5 and equal to or less than 2.0 to obtain effective developing stability, effective developing lifetime, and increased gloss. In addition, the toners of Examples 1 to 5 and Comparative Examples 1 to 5 had a peak temperature of tan δ in the range of 64° C. to 70° C., and thus, exhibited effective levels of fixability and heat storage property.

Evaluation Method of Toner

<Evaluation of Weight-Average Molecular Weight and Molecular Weight Distribution>

A weight-average molecular weight Mw and molecular weight distribution of a toner were measured by gel permeation chromatography (GPC, Alliance Company). 0.1 g of a toner were added to 10 g of THF and stirred for 12 hours at room temperature. An un-dissolved component was removed from the mixture and the resultant mixture was used as a sample.

A refractive index-type (RI) detector (Model: Waters 2414) was used as a detector, and three columns (Model: Strygel HR 5, HR 4, and HR 2) were used. THF was used as an eluent, and a flow rate was 1 ml/min. A concentration of the sample used was 1 wt %, and a volume of the injected sample was 50 μl. Ten reference polystyrene solutions each with a concentration of 0.5 wt % were used for calibration. Conditions for the respective reference polystyrene solutions were as follows:

Reference polystyrene (PS) solution 1: a mixed solution of PS having a molecular weight of 1,200/PS having a molecular weight of 7,210/PS having a molecular weight of 196,000/PS having a molecular weight of 257,000/PS having a molecular weight of 1,320,000/THF with a volumetric ratio of 1:1:1:1:0.5:0.5; and Reference polystyrene solution 2: a mixed solution of PS having a molecular weight of 3,070/PS having a molecular weight of 49,200/PS having a molecular weight of 113,000/PS having a molecular weight of 778,000/PS having a molecular weight of 3,150,000/THF with a volumetric ratio of 1:1:1:1:0.5:0.5.

<Rheological Property Evaluation>

Rheological properties of a toner were measured as follows by using a temperature sweeping method in which a frequency was fixed and a temperature was increased in the range of 40° C. to 140° C.

A peak temperature of loss tangent (tan δ), a peak value of tan δ, and an average value of tan δ at a temperature range of 100° C. to 120° C. were measured according to a sinusoidal wave vibration method in which a sample was inserted into two circular plates each having a diameter of 8 mm with measuring conditions including a sample holder gap (sample thickness) of 2.0 mm, an initial strain of 0.3%, a measurement frequency of 6.28 rad/s, and a heating rate of 2.0° C./min using a Dynamic Mechanical Analyzer (DMA; TA ARES) manufactured by Rheometric Scientific Inc. In this regard, the angular velocity of 6.28 rad/s is a value set based on a fixing rate of a typical fixing unit of an apparatus for forming an image.

<Fixability Evaluation>

An image was printed on five sheets of paper by varying a temperature of a fixing unit at an interval of 5° C. as follows by using a printer jig. The first two of the printed five sheets of paper were thrown away and fixing properties of the remaining printed three sheets of paper were evaluated.

Unfixed Image for Test: Solid Pattern

Test temperature: 155° C. to 210° C. (5° C. interval)

Fixing speed: 146 mm/sec (24 ppm)

Test paper: 90 g paper (Exclusive from Xerox Company).

Fixability of a fixed image was evaluated as follows: After measuring optical density (OD) of the fixed image, 3M 810 tape was adhered to a portion of the image and the tape was removed after reciprocating five times using a 500 g weight. The optical density (OD) was measured after removing the tape.

Fixability was evaluated by the following equation and an average value of the fixabilities of the printed three sheets of paper was calculated:

$$\text{Fixability}(\%)=(\text{Optical density after tape peeling}/\text{Optical density before tape peeling})\times 100.$$

A minimum temperature having the fixability value of 90% or more without cold-offset is defined as a minimum fixing or fusing temperature (MFT). A minimum temperature at which hot-offset occurs is defined as a hot offset temperature (HOT).

<Gloss Evaluation>

A fixed image was printed on five sheets of paper using a printer (manufacturer: Samsung Electronics Co., Ltd, model: Color Laser CLP 620). A fixing temperature and printing speed that had been set to default in the printer were used without being changed.

Image for test: Gm pattern for gloss measurement standardized in ISO 19799

Test paper: 80 g paper (Double A from Xerox Company).

The first two of the printed five sheets of paper were thrown away and gloss properties of the three remaining printed images were evaluated as follows.

A degree (%) of gloss of the fixed image was measured at a measurement angle of 60° by using a gloss measuring instrument, a glossmeter (manufacturer: BYK Gardner, model: micro-TRI-gloss), and an average value of the degree of gloss of the three images was calculated.

<Heat Storage Ability Evaluation>

100 g of a toner was put into a developer (developer of CLP-620) and stored in a packaged state in a constant-temperature and constant-humidity oven under the following conditions:

23° C., 55% relative humidity (RH), 2 hours

⇒ 40° C., 90% RH, 48 hours

⇒ 50° C., 80% RH, 48 hours

⇒ 40° C., 90% RH, 48 hours

⇒ 23° C., 55% RH, 6 hours.

After storing under the above conditions, the presence of toner caking in the developer was identified with the naked eye and image defects were evaluated by printing a 100% solid pattern.

—Evaluation Criteria

○: Good image, no caking

Δ: Inferior image, no caking x: Occurrence of caking.

<Development Lifetime Evaluation>

A 1% coverage solid pattern was continuously printed on 500 sheets of paper by using a printer jig made by adjusting a printer (manufacturer: Samsung Electronics Co., Ltd, model: Color Laser CLP 620) to a contact development method and an optical density of the solid pattern image was measured. The test was performed 14 times each printing 500 sheets of paper, and a point at which the optical density of the image began to decrease was represented as the number of sheets of printed paper. A development lifetime of a toner was evaluated according to the following standard by using a point at which an optical density of an image was maintained.

○: maintaining image concentration for 6,000 or more sheets

Δ: maintaining image concentration for 4,000 or more to less than 6,000 sheets x: maintaining image concentration for less than 4,000 sheets.

In addition, as another items of development lifetime properties, the number of sheets of printed paper at which filming on a developing roller of the printer began to occur and the number of sheets of printed paper at which streaks on a printed image began to occur were also evaluated.

<Average Circularity Evaluation>

The shape of the prepared toners was identified with SEM photographs. The circularity of the toner was calculated based on the following formula using FPIA-3000 from SYSMEX Corporation.

<Formula>

$$\text{Circularity}=2\times(\pi\times\text{area})^{0.5}/\text{circumference}.$$

A value of circularity is in the range of 0 to 1, and a toner particle becomes more spherically-shaped as the value of circularity approaches 1. The average circularity was calculated by averaging circularity values of 3,000 toner particles.

<Particle Size Distribution Evaluation>

A volume average particle size distribution index GSDv and a number average particle size distribution index GSDp, which are particle size distribution indices of toner particles, were measured under the following conditions using a Multisizer III measuring instrument (from Beckman Coulter, Inc) which is a Coulter counter.

Electrolyte: ISOTON II

Aperture diameter: 100 μm

Measured particle number: 30,000.

From the measured particle size distribution of the toner, a cumulative distribution for volume and number of individual toner particles was plotted as a divided particle size range (i.e., channel) in order of increasing diameter. A particle diameter at cumulative 16% is defined as volume average particle size D16v and number average particle size D16p, and a diameter at cumulative 50% is defined as volume average particle size D50v and number average particle size D50p. Similarly, a particle diameter at cumulative 84% is defined as volume average particle size D84v and number average particle size D84p. GSDv and GSDp are calculated by using the following equations.

$$\text{GSD}v=(D84v/D16v)^{0.5}$$

$$\text{GSD}p=(D84p/D16p)^{0.5}.$$

<X-ray fluorescence (XRF) measurement method: [Fe1]>

3 g of a toner sample was formed by using a press-former under the following conditions: a pressing load of 2t and a pressing time of 10 seconds, and [Fe1] was measured using an X-ray fluorescence spectrometer (EDX-720) manufactured by SHIMADZU Corporation. The measurement was performed under the conditions of a tube voltage of 15 kV and a tube electrical current of 100 μA, and [Fe1] was obtained from an elemental composition ratio.

<XPS measurement method: [Fe2]>

[Fe2] of the toner sample was measured using an X-ray photoelectron spectrometer (ULVAC-PHI Inc. S5000). The measurement conditions were as follows: X-ray source of MgKα(400 W) and an analysis area of 0.8×2.0 mm.

As described above, the toner for developing an electrostatic charge image according to one or more embodiments of the present general inventive concept may have development stability, development lifetime, fixability, charging stability, gloss, an anti-offset property, and heat storage ability all at predetermined levels or higher. Therefore, the toner according to one or more embodiments of the present general inventive concept may stably provide a an increased-quality image for an extended period of time without contaminating a one-component contact developing type image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner to develop an electrostatic charge image, the toner comprising at least a binder resin, a colorant, and a releasing agent, wherein the binder resin comprises at least two kinds of binder resin having different weight average molecular weights, wherein a peak temperature of a loss tangent (tan δ) of the toner is equal to or greater than 64° C. and less than 70° C. and an average value of the loss tangent (tan δ) at a temperature ranging from 100° C. to 120° C. of the toner is equal to or greater than about 1.5 and equal to or less than about 2.0 in a dynamic viscoelasticity measurement conducted as a function of temperature under a condition of a measurement frequency of 6.28 rad/s, a heating rate of 2.0° C./min, and an initial strain of 0.3%, where tan δ is a tangent of a phase angle δ between deformation and response when stress or strain is applied to the toner.

2. The toner of claim 1, wherein a molecular weight distribution curve of the toner obtained by using a gel permeation chromatography (GPC) method on a tetrahydrofuran (THF) soluble fraction has a main peak in a molecular weight range of about 10,000 to about 30,000 g/mol and a shoulder-type secondary peak whose shoulder starting point is located in a molecular weight range of about 100,000 to about 600,000 g/mol.

3. The toner of claim 1, wherein the toner comprises about $1.0\times10^3$ to about $1.0\times10^4$ ppm of iron (Fe) and about $1.0\times10^3$ to about $5.0\times10^3$ ppm of silicon (Si).

4. The toner of claim 1, wherein, when a total iron concentration of a toner and an iron concentration present on a surface of the toner determined by X-ray fluorescence (XRF) measurements are denoted as [Fe1] and [Fe2], respectively, the ratio of [Fe2] to [Fe1] of the toner satisfies the following condition: $0.05\leq[\text{Fe2}]/[\text{Fe1}]\leq0.5$.

5. The toner of claim 1, wherein the releasing agent comprises a paraffin-based wax and an ester-based wax, an amount of the ester-based wax is about 10 wt % to about 50 wt % based on the total weight of the paraffin-based wax and the ester-based wax, and a difference between a solubility parameter (SP) of the binder resin and an SP of each of the paraffin-based wax and the ester-based wax is about 2 or more.

6. The toner of claim 1, wherein the toner has a core-shell structure comprising a core layer comprising the binder resin, the colorant, and the releasing agent and a shell layer covering the core layer and comprising the binder resin.

* * * * *